US005310431A

United States Patent [19]

Buck

[11] Patent Number: 5,310,431

[45] Date of Patent: May 10, 1994

[54] CREEP RESISTANT, PRECIPITATION-DISPERSION-STRENGTHENED, MARTENSITIC STAINLESS STEEL AND METHOD THEREOF

[75] Inventor: Robert F. Buck, N. Huntingdon, Pa.

[73] Assignee: Robert F. Buck, North Huntingdon, Pa.

[21] Appl. No.: 957,724

[22] Filed: Oct. 7, 1992

[51] Int. Cl.[5] ..... C22C 38/30

[52] U.S. Cl. ..... 148/325; 148/326; 148/607; 148/622; 148/328

[58] Field of Search ..... 118/325, 326, 328, 335, 118/607, 622; 420/38, 107, 109

[56] References Cited

U.S. PATENT DOCUMENTS

| | | | |
|---|---|---|---|
| 2,132,877 | 11/1936 | Naumann . | |
| 2,283,916 | 9/1940 | Comstock . | |
| 2,397,997 | 4/1946 | Wyche et al. . | |
| 2,469,887 | 10/1945 | Olcott . | |
| 2,597,173 | 2/1951 | Patterson . | |
| 2,693,413 | 11/1954 | Kirby et al. . | |
| 2,745,739 | 5/1956 | Phillips et al. . | |
| 2,747,989 | 5/1956 | Kirby et al. . | |
| 2,793,113 | 5/1957 | Ralt et al. . | |
| 2,848,323 | 8/1958 | Harris et al. . | |
| 2,905,577 | 9/1959 | Harris et al. . | |
| 3,152,934 | 10/1964 | Lula et al. . | |
| 3,154,412 | 10/1964 | Kasak et al. . | |
| 3,251,683 | 5/1966 | Hammond . | |
| 3,291,655 | 12/1966 | Gill et al. . | |
| 3,365,343 | 1/1968 | Vordahl . | |
| 3,539,338 | 11/1970 | Mimino et al. . | |
| 3,661,658 | 5/1972 | Oda et al. . | |
| 3,677,744 | 7/1972 | Yamamura et al. . | |
| 4,405,369 | 9/1983 | Otogura et al. . | |
| 4,640,722 | 2/1987 | Gorman . | |
| 4,799,972 | 1/1989 | Masuyama et al. . | |
| 4,846,904 | 7/1989 | Arai et al. . | |
| 5,069,870 | 12/1991 | Iseda et al. . | |
| 5,102,619 | 4/1992 | Garrison, Jr. et al. | 420/109 |
| 5,116,571 | 5/1992 | Abe et al. | 420/110 |

FOREIGN PATENT DOCUMENTS

| | | | |
|---|---|---|---|
| 0242854 | 10/1962 | Australia . | |
| 2148421 | 4/1972 | Fed. Rep. of Germany . | |
| 1177028 | 4/1959 | France . | |
| 50-7528 | 3/1975 | Japan . | |
| 51-2615 | 1/1976 | Japan . | |
| 55-028348 | 2/1980 | Japan . | |
| 55-079857 | 6/1980 | Japan . | |
| 55-110758 | 8/1980 | Japan . | |
| 55-134159 | 10/1980 | Japan | 420/38 |
| 60-029448 | 2/1985 | Japan . | |
| 0921838 | 3/1963 | United Kingdom . | |
| 976735 | 12/1964 | United Kingdom | 420/38 |

OTHER PUBLICATIONS

"Heat Resistant Steels for Advanced Power Plants", *Advanced Materials & Processes*, Apr. 1992, by Toshio Fujita, pp. 42–47.

*Primary Examiner*—Deborah Yee

*Attorney, Agent, or Firm*—Buchanan Ingersoll; Lynn J. Alstadt

[57] ABSTRACT

An iron-based, corrosion-resistant, precipitation strengthened, martensitic steel essentially free of delta ferrite for use at high temperatures has a nominal composition of 0.05–0.1 C, 8–12 Cr, 1–5 Co, 0.5–2.0 Ni, 0.41–1.0 Mo, 0.1–0.5 Ti, and the balance iron. This steel is different from other corrosion-resistant martensitic steels because its microstructure consists of a uniform dispersion of fine particles, which are very closely spaced, and which do not coarsen at high temperatures. Thus at high temperatures this steel combines the excellent creep strength of dispersion-strengthened steels, with the ease of fabricability afforded by precipitation hardenable steels.

21 Claims, 2 Drawing Sheets

CREEP RESISTANT, PRECIPITATION-DISPERSION-STRENGTHENED, MARTENSITIC STAINLESS STEEL AND METHOD THEREOF

STATEMENT OF RIGHTS

The United States Government has a paid-up license in this invention and may have the right in limited circumstances to require the patent owner to license others on reasonable terms as provided for by the terms of Contract No. DE-FG07-89ER12892 awarded by the United States Department of Energy.

FIELD OF THE INVENTION

This invention relates to an iron-based, corrosion-resistant, precipitation strengthened, martensitic steel essentially free of delta ferrite for use at high temperatures. Its nominal composition is (wt. %) 0.05–0.1 C; 8–12 Cr; 1–5 Co; 0.5–2.0 Ni; 0.4–1.0 Mo; 0.1–0.5 Ti, and remainder essentially Fe.

BACKGROUND OF THE INVENTION

Typical corrosion-resistant martensitic steels used at high temperatures contain between 9 and 12 chromium, and 0.08 and 0.25 carbon (wt. %). These steels usually contain several additional carbide forming elements such as molybdenum, tungsten, vanadium and, in some cases, niobium. Additional elements such as silicon, nickel and manganese are also typically added to these steels to deoxidize, reduce delta ferrite formation, and getter the sulfur, respectively. The conventional heat treatment for these steels involves austenitizing in the range ~1000° C. to ~1100° C., air cooling to room temperature (which usually transforms most of the austenite to martensite or bainite) and tempering between ~650° C. and ~750° C. The tempered microstructure usually consists of relatively large, chromium-rich carbides which have nucleated on martensite lath boundaries, prior austenite grain boundaries and other crystalline defects in the ferrite matrix. The precipitate distribution in the tempered martensite is primarily responsible for the rather modest creep strength (to 600° C.) of conventional 9–12 Cr steels. But at temperatures greater than 600° C, these steels are not generally used due to their inferior creep properties. The reason for their inadequate high temperature strength is due to the relatively rapid coarsening kinetics of the chromium carbides. As the precipitates coarsen, the average interparticle spacing increases, which allows dislocations to glide more easily between particles.

A variety of ferritic steels having high chromium content have been proposed. Many of these steels are said to be creep resistant. Creep resistance is usually measured by applying a stress to the steel while the steel is at an elevated temperature, typically 600°–700° C. Then one measures either the creep strain over time (the steady-state creep rate) or the time which passes until the steel ruptures. The rupture time for most steels can be found in the literature or calculated. Under conditions of 200 MPA and 650° C., many 9–12 Cr martensitic steels rupture within about 100 hours; I am not aware of any 9–2 Cr steel which has an actual or predicted rupture time of more than 1,000 hours. There is a need for a steel which will not rupture after 1,000 hours of service under these conditions.

SUMMARY OF THE INVENTION

I provide an iron based alloy, preferably having 9–12% chromium, which has superior creep strength. The outstanding creep strength of this steel is attributable to the interparticle spacing being small, and remaining small during creep. This steel contains an initial distribution of MX precipitates spaced less than 200 nm on average from each other. Appropriate alloy chemistry and proper heat treatment are chosen which results in a microstructure whereby most of the interstitial solute (typically carbon) is in the form of small MX particles (M=V, Ti, Nb, Ta, Hf and Zr and X=C and N). These precipitates are known as secondary precipitates to distinguish them from those which are not dissolved after austenization, which are known as primary precipitates. Secondary MX precipitates are typically small (10–100 nm) while primary MX are usually large (0.5–3 μm).

The steel of the current invention is significantly different form the conventional 9–12 Cr martensitic steels in three important ways. First, the second phase particles used to strengthen the steel are primarily the MX-type (NaCl crystal structure) rather than the chromium-rich carbides such as $M_{23}C_6$ and $M_6C$. Second, the MX particles are very fine (<35 nm) and are much smaller than the relatively large (0.1–0.3 μm) Cr-rich carbides. Moreover, the MX precipitates precipitate homogeneously throughout the bulk material, rather than primarily on lath or grain boundaries, as in the conventional 9–12 Cr steels. Finally, the MX particles do not coarsen appreciably during long term holds at high creep temperatures to about 700° C. Thus, the average interparticle spacing is small and remains so during creep. Conversely, Cr-rich particles coarsen readily at temperatures above about 600° C. in conventional 9–12 Cr steels.

The steel of the present invention may be used in such high temperature applications as boiler tubes, steam headers, and turbine rotors and blades in conventional fossil-fueled steam generating stations, cladding material in fast nuclear reactors, discs and other components in gas turbines, and in the chemical and petrochemical industries.

Other objects and advantages will be apparent from a description of the preferred embodiments.

BRIEF DESCRIPTION OF THE TABLES AND DRAWINGS

Table I lists for selected steels of the prior art each steel's composition.

Table II lists austenitizing temperature, solute efficiency (calculated), M-X pair number density (calculated) and $10^5$ hour rupture strength at 650° C.

Table III lists the composition, austenizing temperature, solute efficiency and MX pair number density for alloys of the present invention.

Table IV lists equilibrium solubility products of nitrides and carbides in solid iron.

Tables V and VI report the solute efficiency and MX pair number density for seven prior art alloys, the alloy of Example A and the alloy of Example P and the parameters used to calculate those values.

DESCRIPTION OF PREFERRED EMBODIMENTS

For any given steel one can calculate the volume fraction of precipitates by knowing the steel's composition and thermal history. This precipitate volume fraction would include all precipitates, including $M_{23}C_6$, MC and others. The solutionizing (or austenitizing) temperature, typically about 1050° C., was not generally considered to be critical in determining precipitate volume fraction or creep strength. It was thought that creep strength was proportional to precipitate volume fraction. However, at temperatures above about 600° C., this statement is not entirely correct. A more accurate statement would be that creep strength at high temperatures is proportional to the volume fraction of coarsening-resistant, secondary precipitates, namely MX particles, in the steel. Thus, to predict a steel's high temperature creep strength, it would be necessary to determine (or calculate) the number density of secondary MX precipitates. However, the number density of secondary MX precipitates varies, depending on tempering parameters (time and temperature). A better method to quantify the secondary MX number density is to calculate and use the number density of M-X atomic pairs. This quantity can be calculated given the total amounts of M (Ti, V, Nb, Zr, Ta & Hf) and X (C,N) in the steel, and the austenitizing and tempering temperature of the steel. It represents the volumetric density of M.X pairs which would be available for precipitation as secondary MX particles. Because the M-X pair number density is also approximately equal to the number density of carbon and nitrogen atoms which could precipitate as secondary MX particles, one can calculate the steel's "solute efficiency" by dividing the M-X pair number density by the total combined carbon and nitrogen content of the steel, and multiplying by 100.

Although the concept of total volume fraction of precipitates is frequently reported and used in the art, the concept of M-X pair number density, and solute efficiency, and their relationship to creep strength has not been previously recognized.

Figure 1:
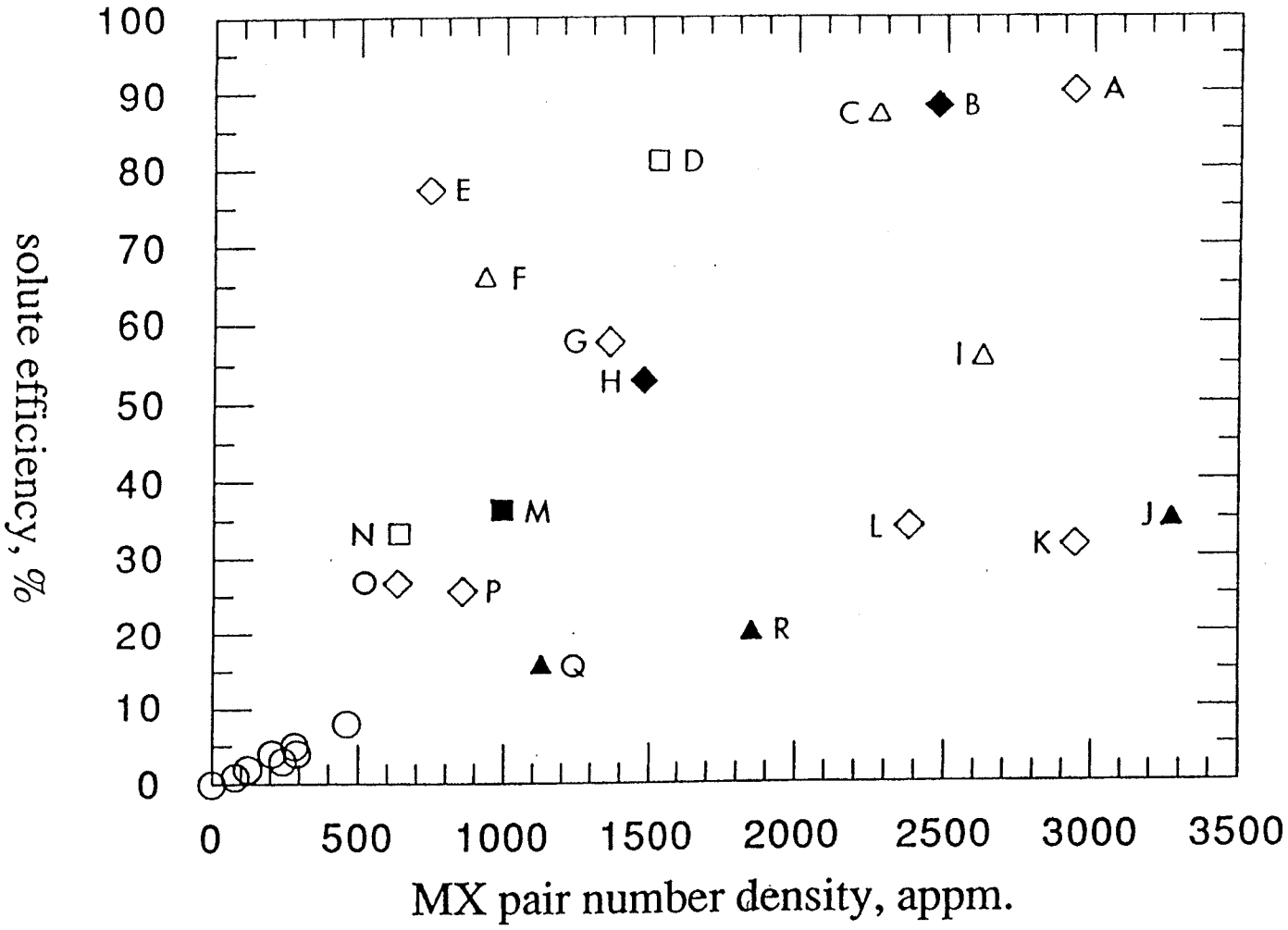
FIG. 1 is a graph showing solute efficiency versus M-X pair number density of the steels reported in Tables I and III.

In FIG. I, I have graphed the solute efficiency versus the M-X pair number density of the alloys listed in Table I. These steels are represented in FIG. 1 as open circles. The actual values of solute efficiency and M-X pair number density of these steels are set forth in Table II. Also shown in FIG. 1 are the solute efficiencies and M-X pair number densities of several embodiments of the steel of the current invention. These points, shown as diamonds, squares and triangles, represent differences in composition (in particular type and amount of M, i.e. Ti, Ta, Zr, Nb, V or Hf, and amount of carbon) and austenitizing temperature of the steel of the current invention. Alloys containing titanium are plotted as open diamonds. Tantalum containing alloys are shown as open squares. Alloys with niobium are indicated by open triangles. Solid triangles indicate vanadium containing alloys. A solid square is used for the alloy with hafnium. And, the solid diamonds denote zirconium containing alloys. The chemistry, austenitizing temperature, solute efficiency and M-X pair number density for these steels appear in Table III. These steels contain approximately the same amounts of chromium, molybdenum, nickel and cobalt, which do not affect the M-X pair value per se. The amounts of these elements are listed in Table III.

Note that the prior art alloys are confined to a relatively small region in the bottom left corner of the graph in FIG. 1. The prior art exhibits both a relatively low solute efficiency (<10%) and a low number density of M-X pairs (<500 appm) for their given (or assumed) solutionizing temperatures.

Figure 2:
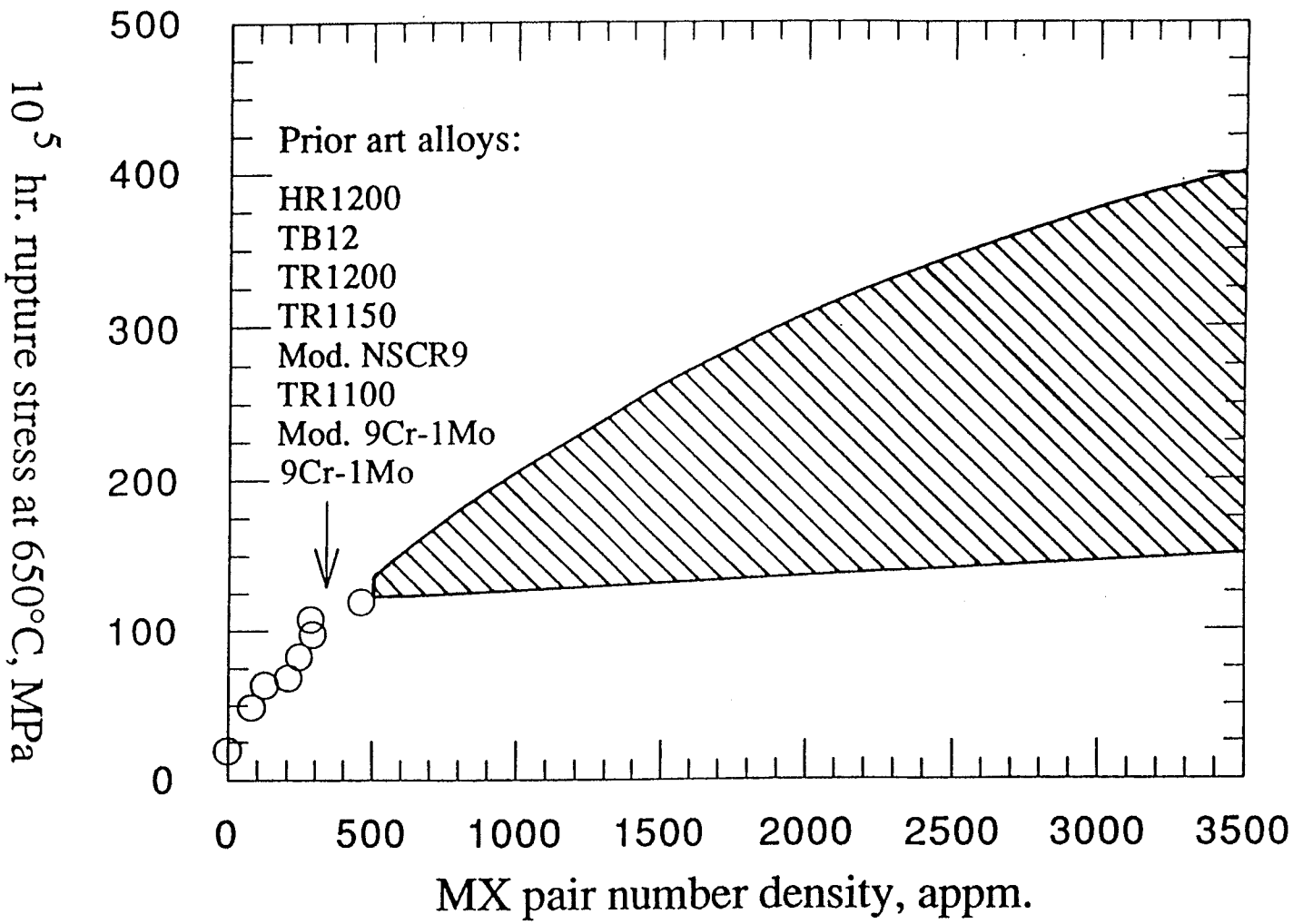
FIG. 2 is a graph showing the $10^5$ hour rupture strength at 650° C. for the various steels listed in Table 1. Rupture strength is plotted against the M-X pair number density.

In FIG. 2, I have plotted the $10^5$ hour creep rupture strength at 650° C. for the prior art alloys graphed in FIG. 1 against the number density of MX pairs. Clearly, as the MX pair number density increases, the rupture strength also increases. From the prior art data I expect there to be a parabolic relationship between rupture strength and MX pair number density. Hence, I am able to improve creep resistance by increasing the MX pair number density. When that is done, the alloy should fall in the shaded area of FIG. 2. Therefore, the steel of the current invention should have a MX pair number density of 500 appm or more, based upon trend in the prior art at lower MX pair number densities. The values for M-X pair number density and solute efficiency can be calculated in the manner described below.

I have found that to substantially increase the long-term creep strength of 9–12 Cr steels, it is necessary to reduce the average interparticle spacing, thereby forming a microstructure of uniformly dispersed, fine MX precipitates in a martensitic matrix. In order to achieve a small average interparticle spacing, the austenization, cooling and tempering processes should result in a high number density of secondary MX particles. The number density of MX precipitates is directly proportional to the number density of M-X pairs, which would be available for secondary precipitation during tempering or aging, given a particular steel's chemistry and heat treatment. Solute efficiency is also important in minimizing the amount of primary (undissolved) MX particles which would be present during austenization if too much metal atoms (i.e. Nb, Ti) and/or C and N are present. These primary MX particles could lower the steel's toughness. Solute efficiency (%) is defined as the amount of carbon (and nitrogen) in the form of secondary MX precipitates divided by the total C and N content of the steel. To maximize creep properties I have found that it is necessary to attain both a high solute efficiency and a high number density of M-X pairs. Both of these quantities can be calculated for a given steel and heat treatment if the solubility product(s) for the MX compound(s) in question is (are) known at both the austenization temperature and the unique tempering temperature above which carbides of Cr, Mo and W do not precipitate. Solute efficiencies and number densities of some of the most creep resistant martensitic 9–12 Cr steels (representing the prior art) usually range from about 1 to 8%, and from about 100 to 500 appm, respectively. The steel HR1200 has the highest solute efficiency (8%) and number density of M-X pairs (462), resulting in the highest creep strength of the other, prior art, martensitic steels. By comparison, one steel of the current invention, example A, has a solute efficiency of 90% and a M-X pair number density of 2940 appm. The projected $10^5$ hour creep strength of this particular steel, from the graph of FIG. 2 is 150–375 MPa.

A high solute efficiency combined with a high number density of secondary M-X pairs, leads to a small average interparticle spacing and hence, excellent creep properties in the steel of the present invention. The steel's service life at high temperatures (under noncyclic stresses) is usually limited by one of three factors: 1) creep strength, which is primarily determined by the precipitate size, distribution, morphology, etc., 2) corrosion/ oxidation resistance, primarily determined by the chromium content (and cobalt and nickel, to a lesser extent), and 3) the Ac1 temperature (the temperature at which the b.c.c. structure begins to transform to f.c.c.). The Ac1 temperature is determined by the amounts of certain dissolved elements in the b.c.c. matrix. Thus, to maximize the steel's service lifetime at 700° C., I chose both a special chemistry and heat treatment, which resulted int he steel having: an Ac1 temperature greater than 730° C., good corrosion resistance, and excellent creep strength. The method of its design will now be explained.

Careful selection of elements from the following six groups is necessary:

i) strong carbide/nitride formers, typically Ti, Nb, V, hf, Zr and Ta;
ii) interstitial solutes, typically C, but also N and/or B;
iii) non-carbide precipitating austenite stabilizing elements, typically, Ni, Co, Mn, Cu, etc.;
iv) ferrite stabilizing elements, typically, Mo, W and Si;
v) corrosion-resistant element(s), typically Cr; and
vi) impurity getterers, typically, Al, Ce, Ca, Y, Mg, La or Be.

The considerations for making such selections are as follows.

1. Strong carbide/nitride forming elements (Ti, Nb, V, Hf, Zr and Ta)

The primary objective during austenization is to dissolve all or most of the primary MX particles. The austenization temperature should thus be the MX dissolution temperature, which depends on the amounts of M and X in the bulk alloy. I have found that if primary MX particles remain after solutionization, then creep properties are degraded, since creep cavities tend to form at the interface between the relatively large, undissolved primary MX particles, and the martensitic matrix. The alloy should be kept at the austenitizing temperature for a time period sufficient to result in a homogeneous distribution of the strong carbide former(s). The proper amount of strong carbide forming elements should equal or approximate the atomic stoichiometry of carbon and/or nitrogen present for formation of MX precipitates. Then the alloy should be tempered to precipitate the coarsening-resistant particles. After the alloy has been aged correctly, it may be tempered at a temperature below the original aging temperature. However, because the austenite grain size may be large following the initial high temperature austenization, the grain size may be refined by conventional hot working or other metallurgical techniques, followed by the tempering process described above.

To achieve the desired creep strength, the amounts of these elements (Ti, Nb, Hf, Zr and Ta) should range from about 0.1 wt. % to about 1 wt. %, whereas if V is the primary strong carbide former used, it should range from 0.1 wt. % to 2 wt. %. Below 0.1 wt. % these elements cannot yield a secondary M-X pair number density high enough to substantially improve creep properties, while adding more than the specified amounts will lead to excessive amounts of primary MX particles being present in the matrix.

2. Interstitial solute elements (C and N)

The amount of C or N added depends upon the amount of strong carbide formers present and should approximate a 1:1 stoichiometry. Note if Ti, Zr, Nb, Hf or Ta are present in quantities greater than 0.1 wt. %, the amount of nitrogen should be minimized since primary nitrides of these elements will not dissolve appreciably even at very high solutionizing temperatures. Typically to achieve high M-X number densities, C and/or N should be added in the range about 0.02 wt. % to about 0.2 wt. % and N should be less than about 0.05 wt. %.

3. Non-carbide forming austenite stabilizing elements (Ni, Co, Mn and Cu) and ferrite stabilizing elements (Mo, W and Si)

Sufficient austenite stabilizing elements, including soluble carbon and nitrogen, should be present to maintain the structure austenitic during solutionization, thereby minimizing the presence of delta ferrite. But, since austenite stabilizing elements typically lower the Ac1, it is desirable to add elements which raise the Ac1, i.e., ferrite stabilizing elements. I have found that the amount of delta ferrite in the structure is dependent upon the relative amounts of ferrite stabilizing elements and austenite stabilizing elements present. In general to attain a structure containing less than about 30% delta ferrite, the following relation should be met:

$$NI > CR - 10.$$

In order to minimize the delta ferrite content, i.e., delta ferrite content = ~0%, it is generally required that:

$$NI > CR - 7$$

where

NI = nickel equivalent (wt %) = $Ni + (0.11\ Mn) - 0.0086\ Mn^2 + 0.41Co + 0.44Cu + 18.4N$ (in solution at the austenitizing temperature) + 24.5C (in solution at the austenitizing temperature), and CR = chromium equivalent (wt %) = $Cr + 1.21Mo + 2.27V + 0.72W + 2.2Ti + 0.14Nb + 0.21Ta + 2.48Al$.

But because Ni and Mn markedly lower the Ac1 and thereby limit the useful temperature of the steel, the respective amounts of each of these two elements should be not exceed about 5% of each element. However, for a given amount of chromium equivalent elements, to minimize delta ferrite formation during austenization, other austenite stabilizing elements must be added to meet the minimum NI required for 0% delta ferrite. These other elements include Co, Cu, and Zn. Cobalt is the preferred element since the Ac1 is not greatly influenced (lowered) by cobalt additions. Copper may be added at the risk of precipitating Cu-rich particles.

Addition of ferrite stabilizing elements such as Mo, W and Si fulfills two primary roles in this steel: 1) these elements raise the Ac1, thereby permitting higher operating temperatures and 2) these elements promote solid solution strengthening, albeit minimally at high operating temperatures. By raising the Ac1 these elements balance the tendency of Mn, Ni and to some extent, Co, from lowering it. The Ac1 can then be calculated by: $Ac1(°C.) = 760 - 5Co - 30Ni - 25Mn + 10W + 25Si + 25Mo + 50V$ wherein all elements are in weight percent. Note that the levels of austenite stabilizers and ferrite formers used to predict Ac1 in the above formulation are only the amounts which remain in solution during service. For example, since vanadium is a strong carbide former, and if it is used to form $VC_x$, only a fraction of it will remain in solution after carbide formation, and it is only this amount which acts to raise the Ac1. The Ac1 should be at least 30° C. greater than the expected maximum service temperature to reduce the probability of the alpha/gamma phase transformation occurring. Moreover, the amounts of W and Mo should not exceed the solubility limit of WC and MoC and/or other tungsten and molybdenum carbides at the aging temperature, since if the solubility limit is exceeded, C may precipitate as tungsten or molybdenum carbides, which are not considered coarsening resistant precipitates at temperatures greater than 600° C. The respective amounts of Mn, Cu and Ni should be limited to less than 5 wt. %; Co should not exceed 10 wt. %; and the chromium equivalent minus the nickel equivalent should be no greater than 7. Regarding the ferrite stabilizing elements, molybdenum should be not more than about 2.4 wt. %, silicon should not exceed 1.5 wt. %, and Mo+Si+W should not exceed 4 wt. %. If these limits are exceeded, creep properties will be adversely impacted.

4. Corrosion and oxidation resistance, Cr

For good oxidation and corrosion resistance at high temperature, the alloy must contain the appropriate amount of chromium (or other element which promotes corrosion resistance). The amount of Cr employed depends on the level of corrosion resistance desired. To maintain a delta ferrite free structure at solutionizing temperatures, CR (chromium equivalent) should be limited to about 14% (thus the maximum Cr level would be about 14% if no other ferrite stabilizing elements were added). But for strength at high temperatures, other ferrite stabilizing elements must be added; the preferred MX particle being TiC. Note that the strong carbide forming elements are also Cr equivalent elements. Thus, the total amount of CR elements (which includes Cr, the strong carbide formers and the ferrite stabilizers) must not exceed the limit determined by $NI > CR - 7$, if delta ferrite formation is to be avoided. But the amount of NI must be limited to $Ni < 5$ wt. % and $Mn < 5$ wt. % if the Ac1 is not to be lowered greatly, such that the ultimate operating temperature is limited by a low Ac1. If good high temperature corrosion resistance is desired, the chromium content should range from 7.5–14.5 wt. % Cr, but beyond the upper limit, delta ferrite formation is probable.

5. Impurity getterers (Al, Ce, Ca, Y, Mg, La, Be)

Appropriate amounts of oxygen and nitrogen getterers should be added, as well as sulfur getterers, including titanium, manganese and/or lanthanum. Typically the total amount of these elements should be limited to less than 1 wt. %.

6. Impurities (S, P, Sn, Sb, O, etc.)

To maintain adequate fracture toughness, the total impurity level should be limited to about 0.1 wt. %, with each impurity limited to about 0.02 wt. %.

Creation of a martensitic, corrosion-resistant steel with excellent creep properties at temperatures up to about 700° C. involves choosing the appropriate amounts of carbon (and/or nitrogen) and strong carbide forming element(s) and precipitating them as a fine dispersion of coarsening-resistant particles; balancing the amounts of non-precipitating austenite and ferrite stabilizing elements to maintain a transformable austenite structure at high solutionizing temperatures and which results in a steel with a high Ac1 temperature; adding the appropriate amount of chromium for adequate corrosion/oxidation resistance; and adding sufficient quantities of impurity gettering elements.

EXAMPLE I

Based upon these considerations I prefer to provide an iron based alloy having good corrosion/oxidation resistance and high strength at elevated temperatures comprising having the composition:

| | |
|---|---|
| C | 0.05–0.15 |
| Cr | 2–15 |
| Co | 0.1–10 |
| Ni | 0.1–4.0 |
| Mo | 0.1–2.0 |
| Ti | 0.1–0.75 |
| B | <0.1 |
| N | <0.1 |

and, with other impurities, the remainder essentially iron. I heat treat this alloy at temperatures above 1100° C. to form a face centered cubic structure. Then the alloy is cooled to room temperature during which it transforms to a body centered cubic structure. I prefer not to cool the alloy directly from 1100° C. to room temperature. Rather I cool to about 900° C. for about ½ hour and then cool to room temperature.

EXAMPLE II

A second preferred composition consists essentially of (in wt. %):

| | |
|---|---|
| C | 0.05–0.15 |
| Cr | 7.5–14.5 |
| Ni | <5 |
| Cr + Ni | 5.0–14.5 |
| Co | <10 |
| Co + Ni | >1 |
| Cu | <5 |
| Mn | <5 |
| Mo | <2.6 |
| Si | <1.5 |
| W + Si + Mo | <4 |
| Ti | <0.75 |
| Zr | <2 |
| Ta | <4 |
| Hf | <4 |
| Ti, Zr, Ta, Hf present such that: | |
| 0.135 < 1.17Ti + 0.6Zr + 0.31Ta + 0.31Hf < 1.0 | |
| Nb | <1 |
| V | <2 |
| N | <0.05 |
| N − 0.5 Al | <0.015 |
| Al, Ce, Mg, Sc, Y, La, Be < 0.1 | |
| B | <0.1 |
| S, P, Sn, Sb, O < 0.1, total; and < 0.02, individual impurity | |
| the balance essentially iron | |

This structure contains less than 40 vol. % delta ferrite. The alloy has an Ac1 temperature between 500° C.–820° C.

EXAMPLE III

A third preferred composition consists essentially of (in wt. %):

| | |
|---|---|
| Cr | 8–10 |
| C | 0.02–0.2 |
| N | <0.02 |
| Si | <0.1 |
| Mo | 0.04–0.08 |

-continued

| | |
|---|---|
| W | <0.01 |
| Ni | 0.5-2.0 |
| Mn | <0.5 |
| Cu | <0.1 |
| Co | 0.5-5 |
| V | <0.1 |

$0.1 < 1.17Ti + 0.6Nb + 0.6Zr + 0.31Ta + 0.31Hf < 1.0$
and the balance iron.

The alloy is solution treated by heating the same at a temperature higher than 1100° C., whereby the structure at said solutionizing temperature is greater than 60 volume % austenite. The alloy is cooled in such a way as to result in a martensitic, bainitic or ferritic microstructure with an Ac1 temperature greater than 500° C., that contains a fine dispersion of MX precipitates (where M=Zr, V, Ti, Ta, Hf, Nb; and X=C,N), in which more than 50% of the bulk material is comprised of a fine dispersion of secondarily precipitated MX particles in which the average M-X interparticle spacing is less than 200 nm. The alloy may be in a cast or forged condition. One can calculate the solute efficiency and M-X pair number density for this alloy as described below. I have made such calculations for alloys containing 9.5Cr, 0.6Mo, 3.0Co, 1.0Ni, C and M where the C and M are varied as noted in Table III. These alloys are plotted in FIG. 1. It is apparent from the graph that all of my steels have higher solute efficiencies and higher M-X pair number densities than any prior art alloy. Since creep resistance is directly related to these factors, my alloys will also have superior creep resistance and should fall within the shaded area of FIG. 2.

Calculation of Solute Efficiencies and MX Pair Number Densities for Several Steels A technique used to calculate the "solute efficiency" and number density of M-X pairs (typically M=Nb, V and Ti, but could also include Zr, Ta and Hf) which would be available for precipitation can be illustrated for TR1200. The composition of this alloy is given in Table 1. The important elements are 0.13 wt. % carbon, 0.05 wt. %, nitrogen, 0.08 wt. %, niobium, and 0.20 wt. % vanadium.

It is first necessary to convert these values to atomic percent. To do this we assume that the average weight of the alloy is the atomic weight of iron or about 56. Then the approximate atomic percent of an alloying element in an iron-based steel can be estimated by multiplying the wt. % of element in question by the element's unique multiplication factor. The multiplication factor is found by dividing the average atomic weight of the alloy (56, for most ferrite steels) by the element's atomic weight. Thus, for example, the multiplication factor for carbon (atomic wt.=12) is 56/12=4.67; for nitrogen is 56/14=4.0; for niobium is 56/93=0.6; and for vanadium is 56/51=1.1. Thus, the amounts of these four important elements in atomic percent are as follows:

C: 0.13 wt. %*4.67=0.607 atom % or 6070 appm
N: 0.05 wt. %*4.0=0.200 atom % or 2000 appm
Nb: 0.08 wt. %*0.6=0.048 atom % or 480 appm
V: 0.20 wt. %*1.1=0.220 atom % or 2200 appm Now we must assume a solutionizing (austenitizing) temperature of about 1200° C.

Next we must identify the compound in this steel that would have the lowest solubility at 1200° C. By consulting the literature, for the solubility products (atom %)$^2$ of various MX compounds (and Mo and W carbides) it is clear that for TR1200 containing V, Nb, C and N, among others, the compound with the smallest solubility is NbN (the other possibilities were NbC, $VC_x$ and VN). But since carbon and nitrogen are both present, the Nb will form Nb(C,N) for which I do not have explicit solubility product (atom %)$^2$ data. However, solubility product data in units of (wt. %)$^2$ for NbC and NbN and other compounds at various temperatures is available from Kiichi Narita's article "Physical Chemistry of the Groups IVa (Ti, Zr), Va (V, Nb, Ta) and the Rare Earth Elements in Steel" Transactions ISIJ, Vol. 15, 1975. Table IV reports pertinent values from that article. It is reasonable to assume that the solubility product, K, for Nb (C,N) at a given temperature lies somewhere between that for NbC and NbN. First, though, Narita's solubility product data (wt. %)$^2$ given in Table IV must be converted into units of (atom %)$^2$. This is done by multiplying K (wt. %)$^2$ by the appropriate multiplication factors. For NbC they are: 0.6 (for Nb) and 4.67 (for C); for NbN they are 0.6 and 4.0 (for N). Because the ratio of C to C+N is about 0.75, the solubility product of Nb(C,N) in units of (atom %)$^2$ can be estimated to be the weighted average of NbC and NbN, or: $0.75(4.67)(0.6)[K_{NbC,1200}(\text{wt. }\%)^2]+0.25(4.0)(0.6)[K_{NbN,1200}(\text{wt. }\%)^2]$. From Table IV (Narita's data) $[K_{NbC,1200}(wt.\ \%)^2]=1.1\times10^{-2}$ and $[K_{NbN,1200}(wt.\ \%)^2]=1.3\times10^{-3}$. Thus, I estimate $K_{Nb(C,N),1200}(\text{atom }\%)^2$ to be about $2.3\times10^{-2}$.

After estimating K, and knowing the amounts of Nb, C and N, we can calculate the amount of Nb(C,N) which will not be dissolved at 1200° C. For simplicity, I add the atomic percents of C and N and use the total solute content in subsequent calculations. Here $$C+N=0.6071+0.2000=0.8071\ atom\ \%\ (8071\ appm).$$

At any solutionizing temperature, one may use the following relation to calculate the amount of undissolved Nb(C,N):

$$K=Nb^2_{NbC}-Nb_{NbC}(Nb_T+C_T)+Nb_TC_T \qquad \text{(b 1)}$$

This important equation is just the definition of the solubility product, K, and other basic definitions, where:

$$K=Nb_{sol}*C_{sol}$$

(the product of the amount (atomic percent) of Nb and C in solution at the austenitizing temperature) and $$Nb_{sol}=Nb_T-Nb_{NbC}$$

(the amount of Nb remaining in solution equals the total amount of Nb in the steel (atom%) minus that which is present as precipitated primary NbC at the austenitizing temperature)

$$C_{sol}=C_T-C_{NbC}$$

(same is true for carbon)

$$C_{NbC}=Nb_{NbC}$$

(since the stoichiometry of the compound NbC is 1:1, the amount of C in NbC approximately equals that amount of Nb in NbC)

Substituting equations (3), (4) and (5) into (2)

$$K=(Nb_T-Nb_{NbC})(C_T-C_{NbC})$$

$$K=Nb_TC_T-Nb_TC_{NbC}-Nb_{NbC}C_T+Nb_{NbC}C_{NbC}$$

but, $C_{NbC}=Nb_{NbC}$, therefore, $$K=Nb^2_{NbC}-Nb_{NbC}(Nb_T+C_T)+Nb_TC_T \text{ or}$$

$$Nb^2_{NbC}-Nb_{NbC}(Nb_T+C_T)+Nb_TC_T-K=0$$

This is just a quadratic equation (in $Nb_{NbC}$) in which the coefficients are:

$$a_2=1$$

$$a_1=-(Nb_T+C_T)$$

$$a_0=Nb_TC_T-K$$

Thus, to determine the amount of Nb in the form NbC at the solutionizing temperature, one must determine $a_1$ and $a_0$ which only depends on the total amounts of Nb and C, expressed in atom percent, and K, the solubility product expressed as (atom %)$^2$ of Nb(C,N) at the solutionizing temperature.

For TR1200, at 1200° C.:

$$a_1=-(0.048+0.8071)=-0.8551$$

where 0.8071 is the total C+N content $$a_0=(0.048)(0.8071)-0.023=0.0157$$

This quadratic equation has two possible roots: 0.83 and 0.0188. But because the amount of NbC cannot exceed the total Nb content of 0.048, the correct root is 0.0188 (atom %). Thus, out of a total of 480 appm Nb, 188 appm Nb are in the form of primary Nb(C,N) particles at 1200° C. As a result, 292 appm remain in solution and would be available to precipitate as secondary Nb(C,N) particles. The total C+N is reduced from 8071 to 7669 appm. The number of Nb atoms which actually precipitates as secondary NbC depends on the tempering temperature. Here it is taken to be 900° C. The aging temperature of 900° C. was chosen because it is assumed that if the alloy is aged at a temperature below this, chromium-rich particles such as $M_{23}C_6$ and $M_6C$ will precipitate rather than MX particles. A similar calculation involving the available Nb and C+N atoms (292 and 7669 appm, respectively) and the estimated solubility product of Nb(C,N) at 900° C. results in the precipitation of 280 (out of 292) appm Nb at 900° C.

Now one must calculate the amount of vanadium which would precipitate at 900° C.

The solubility product for $V_4(CN)_3$ is calculated to be:

$$K_{V(C,N),900} = 0.75(1.1)(4.67)[K_{VC,900}(\text{wt. }\%)^2] + 0.25(1.1)(4.0)[K_{VN,900}(\text{wt. }\%)^2] = 0.162$$

Because $V=0.2$ wt. %(0.22 *atom* %) and $C+N=0.7669$, $$a_1=-[0.22+0.7669]=-0.9869$$

$$a_0=(0.22)(0.7669)-0.162=0.0067$$

The amount of C+N which precipitates as $V_4C_3$ at 900° C. is 0.0068 atom %. But, because $V_4C_3$ precipitates are not as coarsening resistant as NbC or TiC, the "effective number of MX particles" will be less. The enthalpy of formation of $V_4C_3$ is about one-half that of TiC. Thus, by multiplying the 68 appm value by about 0.5, the "effective M-X pairs" from $V_4C_3$ precipitation is about 33 appm. The total M-X pair number density, then, includes the contribution from Nb(CN) and V(CN) and equals 280+33=313 appm.

To determine the solute efficiency, defined as the amount of C+N in the form of M-X pairs divided by the total amount of C+N, one can take 313 appm/8071 appm=0.04 or 4%.

A similar approach was taken for the other steels, where a solutionizing temperature for the martensitic steels was assumed to range from 1050° to 1200° C. and an aging temperature for MX precipitates was taken as 900° C.

The solute efficiency K and MX pair number density, appm, for alloys of the present invention can be calculated. Both will depend upon whether one or more of titanium, zirconium, niobium, hafnium, tantalum and vanadium are present. Solute efficiency can be determined from the solubility product, $K_{MX,T}$, using the precipitating temperature and the austenizing temperature as T.

$$K_{MX,T}=K_{MX,aust.} \text{ or } K_{MX,900}$$

Hence, the calculation is as follows:

$$K_{MX,T} = k_{Ti}K_{TiX,a} + k_{Zr}K_{ZrX,a} + k_{Nb}K_{NbX,a} + k_{Ta}K_{TaX,a} + k_{Hf}K_{HfX,a}$$

$k_{Ti} = Ti_A/M_A$ $\quad Ti_A = 1.17Ti(\text{wt. }\%)$
$k_{Zr} = Zr_A/M_A$ $\quad Zr_A = 0.6Zr(\text{wt. }\%)$
$k_{Nb} = Nb_A/M_A$ $\quad Nb_A = 0.6Nb(\text{wt. }\%)$
$k_{Ta} = Ta_A/M_A$ $\quad Ta_A = 0.31Ta(\text{wt. }\%)$
$k_{Hf} = Hf_A/M_A$ $\quad Hf_A = 0.31Hf(\text{wt. }\%)$
$K_{TiX,a} = C_A/CN_A(K_{TiC,a}) + N_A/CN_A(K_{TiN,a})$
$K_{ZrX,a} = C_A/CN_A(K_{ZrC,a}) + N_A/CN_A(K_{ZrN,a})$
$K_{NbX,a} = C_A/CN_A(K_{NbC,a}) + N_A/CN_A(K_{NbN,a})$
$K_{TaX,a} = C_A/CN_A(K_{TaC,a}) + N_A/CN_A(K_{TaN,a})$
$K_{HfX,a} = C_A/CN_A(K_{HfC,a}) + N_A/CN_A(K_{HfN,a})$
$K_{TiC,a} = KF(TiC)K_{TiC,w}$ $\quad K_{TiN,a} = KF(TiN)K_{TiN,w}$
$K_{ZrC,a} = KF(ZrC)K_{ZrC,w}$ $\quad K_{ZrN,a} = KF(ZrN)K_{ZrN,w}$
$K_{NbC,a} = KF(NbC)K_{NbC,w}$ $\quad K_{NbN,a} = KF(NbN)K_{NbN,w}$
$K_{TaC,a} = KF(TaC)K_{TaC,w}$ $\quad K_{TaN,a} = KF(TaN)K_{TaN,w}$
$K_{HfC,a} = KF(HfC)K_{HfC,w}$ $\quad K_{HfN,a} = KF(HfN)K_{HfN,w}$ (If $K_{HfC,a}$, $K_{HfC,w}$, $K_{HfN,a}$ and/or are not known, each can be estimated to be, $K_{TaC,a}$, $K_{TaC,w}$, $K_{TaN,a}$ and $K_{TaN,w}$, respectively, for the calculation of MX and solute efficiency.)

$KF(TiC) = 5.464$ $\quad KF(TiN) = 4.68$
$KF(NbC) = 2.802$ $\quad KF(NbN) = 2.40$
$KF(ZrC) = 2.802$ $\quad KF(ZrN) = 2.40$
$KF(TaC) = 1.448$ $\quad KF(TaN) = 1.24$
$KF(HfC) = 1.448$ $\quad KF(HfN) = 1.24$ To determine the number density of M-X pairs, and the solute efficiency, I define:

$$MX\text{-}I = 0.5[M_p + CN_p - \{(M_p + CN_p)^2 - 4(M_pCN_p - K_{MX,900})\}^{\frac{1}{2}}]$$

$$MX\text{-}II = 0.21[V_p + CN_s - \{(V_p + CN_s)^2 - 4(V_pCN_s - K_{VX,900})\}^{\frac{1}{2}}]$$

If V and *M* are present:
i) $MX = MX\text{-}I + MX\text{-}II$ $\quad$ if $V_ACN_p > K_{VX,900}$
ii) $MX = MX\text{-}I$ $\quad$ if $V_ACN_p =$ or $< K_{VX,900}$ -continued If V is present but not $M$:

i) $MX = MX\text{-}II$ if $V_ACN_p > K_{VX,900}$ i) $MX = 0$ if $V_ACN_p$ = or < $K_{VX,900}$ If $M$ is present but not V:

i) $MX = MX\text{-}I$ where:

$M_p = M_A - M_{CN,p}$; $CN_p = CN_A - M_{CN,p}$; $V_p = V_A - V_{CN,p}$ $CN_s = CN_p - 0.75V_{CN,p}$ $CN_p = CN_A - M_{CN,p}$ and:

$M_{CN,p} = 0$ if $M_ACN_A$ < or = $K_{MX,aust.}$, and $M_{CN,p} = 0.5\,[M_A + CN_A - \{(M_A + CN_A)^2 - 4(M_ACN_A - K_{MX,aust.})\}^{\frac{1}{2}}]$ if $M_ACN_A > K_{MX,aust.}$ and:

$V_{CN,p} = 0$ if $CN_pV_A$ < or = $K_{VX,aust.}$, and $V_{CN,p} = 0.5\,[V_A + CN_p - \{(V_A + CN_p)^2 - 4(V_ACN_p - K_{VX,aust.})\}^{\frac{1}{2}}]$ if $V_{CN,p}V_A > K_{VX,aust.}$ $M_A = 1.17Ti(wt.\ \%) + 0.6[Nb(wt.\ \%) + Zr(wt.\ \%)] + 0.31[Ta(wt.\ \%) + Hf(wt.\ \%)]$ $V_A = 1.1V(wt.\ \%)$; $CN_A = 4.67C(wt.\ \%) + 4.0N(wt.\ \%)$ $K_{VX,T}(at.\ \%)^2 = [KF(VX)]\,K_{VX,T}(wt.\ \%)^2$;

$KF(VC) = 5.137$; $KF(VN) = 4.40$

In Tables V and VI, I show the values of the variables in these equations for seven prior art alloys and the two alloys of the present invention, Example A and Example P, austenized at 1300° C. and 1100° C., respectively. M-X pair number density and solute efficiency for each alloy is reported at the bottom of the Tables.

The calculation of MX and solute efficiency can be illustrated for a steel containing (wt. %):

0.2C, 0.02N, 0.1Ti, 0.07Nb and the remainder essentially iron.

I begin with the calculation of $K_{MX}$ at 1200° C.

$Ti_A = 1.17(0.1) = 0.117$; $Nb_A = 0.6(0.07) = 0.042$; $C_A = 4.67(0.2) = 0.934$; $N_A = 4.0(0.02) = 0.08$; $M_A = Ti_A + Nb_A = 0.159$; $CN_A = CN_A + N_A = 1.014$; $Ti_A/M_A = 0.74$; $Nb_A/M_A = 0.26$; $C_A/CN_A = 0.92$; $N_A/CN_A = 0.08$ $$K_{MX,1200} = 0.74(K_{TiX,a,1200}) + 0.27(K_{NbX,a,1200})$$

$$\begin{aligned} K_{TiX,a,1200} &= 0.92(K_{TiC,a,1200}) + 0.08(K_{TiN,a,1200}) \\ &= 0.92[KF(TiC)]K_{TiC,w,1200} + 0.08[KF(TiN)]K_{TiN,w,1200} \\ &= 0.92(5.464)(6.4 \times 10^{-3}) + 0.08(4.68)(4.2 \times 10^{-7}) \\ &= 0.03221 + (1.57 \times 10^{-7}) \\ &= 0.03221 \end{aligned}$$

$$\begin{aligned} K_{NbX,a,1200} &= 0.92(K_{NbC,a,1200}) + 0.08(K_{NbN,a,1200}) \\ &= 0.92[KF(NbC)]K_{NbC,w,1200} + 0.08[KF(NbN)]K_{NbN,w,1200} \\ &= 0.92(2.802)(1.1 \times 10^{-2}) + 0.08(2.40)(1.3 \times 10^{-3}) \\ &= 0.02836 + (2.5 \times 10^{-4}) \\ &= 0.02861 \end{aligned}$$

$$K_{MX,1200} = 0.74(0.03221) + 0.27(0.02861)$$

$$K_{MX,1200} = 3.13 \times 10^{-2}(atom\ \%)^2$$

Similarly, $$K_{MX,900} = 0.74(K_{TiX,a,900}) + 0.27(K_{NbX,a,900})$$

$$\begin{aligned} K_{TiX,a,900} &= 0.92(K_{TiC,a,900}) + 0.08(K_{TiN,a,900}) \\ &= 0.92[KF(TiC)]K_{TiC,w,900} + 0.08[KF(TiN)]K_{TiN,w,900} \\ &= 0.92(5.464)(8.1 \times 10^{-5}) + 0.08(4.68)(\sim 0) \\ &= 4.07 \times 10^{-4} \end{aligned}$$

$$\begin{aligned} K_{NbX,a,900} &= 0.92(K_{NbC,a,900}) + 0.08(K_{NbN,a,900}) \\ &= 0.92[KF(NbC)]K_{NbC,w,900} + 0.08[KF(NbN)]K_{NbN,w,900} \\ &= 0.92(2.802)(4.8 \times 10^{-4}) + 0.08(2.40)(4.4 \times 10^{-5}) \\ &= 1.25 \times 10^{-3} \end{aligned}$$

$$K_{MX,900} = 0.74(4.07 \times 10^{-4}) + 0.27(1.25 \times 10^{-3})$$

$$K_{MX,900} = 6.38 \times 10^{-4}(atom\ \%)^2$$

The amount of undissolved MX pairs ($M_{CN,p}$) must be determined.

$$\begin{aligned} M_{CN,p} &= 0.5\,[0.159 + 1.014 - \{(0.159 + 1.014)^2 - 4[(0.0159)(1.014) - 3.13 \times 10^{-2}]\}^{\frac{1}{2}}] \\ &= 0.124 \end{aligned}$$

By knowing $K_{MX,1200}$, $K_{MX,900}$ and $M_{CN,p}$, MX can be calculated as follows:

(MX=MX−I because no V is present.)

$$\begin{aligned} MX = MX\text{-}I &= 0.5\,[0.0352 + 0.89 - \{(0.0352 + 0.89)^2 - 4[(0.0352)(0.89) - 6.38 \times 10^{-4}]\}^{\frac{1}{2}}] \\ &= 0.0344 (= 344\ appm.) \end{aligned}$$

and

Sol. eff. = 0.0344/1.014 = 0.03(=3%)

Although I have described certain present preferred embodiments of my alloy, and certain methods of making same, it should be distinctly understood that the alloy is not limited thereto but may be variously embodied within the scope of the following claims.

TABLE I

| Steel | Composition, wt. % | | | | | | | | | | |
|---|---|---|---|---|---|---|---|---|---|---|---|
| | C | Si | Mn | Ni | Cr | Mo | W | V | Nb | N | Other |
| TR1100 | 0.14 | 0.05 | 0.05 | 0.6 | 10.2 | 1.5 | — | 0.17 | 0.055 | 0.040 | — |
| TR1150 | 0.13 | 0.05 | 0.50 | 0.7 | 10.7 | 0.4 | 1.8 | 0.17 | 0.060 | 0.045 | — |
| TR1200 | 0.13 | 0.05 | 0.50 | 0.8 | 11.0 | 0.15 | 2.5 | 0.20 | 0.080 | 0.050 | — |
| HR1200 | 0.11 | 0.05 | 0.50 | 0.5 | 11.0 | 0.15 | 2.6 | 0.20 | 0.080 | 0.025 | 3.0Co, 0.015B |
| 9Cr-1Mo | 0.10 | 0.50 | 0.40 | — | 9.0 | 1.0 | — | — | — | 0.02 | — |
| Mod 9Cr-1Mo | 0.10 | 0.35 | 0.45 | <0.2 | 8.75 | 0.95 | — | 0.21 | 0.08 | 0.05 | — |
| Mod NSCR9 | 0.08 | 0.05 | 0.50 | 0.10 | 9.0 | 1.6 | — | 0.16 | 0.05 | 0.03 | 0.003B |
| TB12 | 0.08 | 0.05 | 0.50 | 0.10 | 12.0 | 0.5 | 1.8 | 0.20 | 0.05 | 0.05 | 0.003B |

TABLE II

| Steel | $T_{aust.}$ (°C.)[1] | Sol. Eff. (%)[2] | Mx (appm)[3] | $10^5$-hr strength, (MPa)[4] 650° C. |
|---|---|---|---|---|
| 9Cr-1Mo | 1050 | 0 | 0 | 20 |
| Mod 9Cr-1Mo | 1050 | 1 | 79 | 49 |
| TR1100 | 1100 | 2 | 124 | 64 |

TABLE II-continued

| Steel | $T_{aust.}$ (°C.)[1] | Sol. Eff. (%)[2] | Mx (appm)[3] | $10^5$-hr strength, (MPa)[4] 650° C. |
|---|---|---|---|---|
| Mod NSCR9 | 1100 | 4 | 206 | 69 |
| TR1150 | 1150 | 3 | 244 | 83 |
| TR1200 | 1200 | 4 | 313 | 98* |
| TB12 | 1200 | 5 | 283 | 108 |
| HR1200 | 1200 | 8 | 462 | 120 |
| Example A | 1300 | 90 | 2940 | >159 MPa, projected |

[1]Austenitizing temperatures are assumed based upon the literature.
[2]Solute efficiencies were calculated by using 900° C. as the tempering temperature.
[3]MX is the number density of MX pairs that would precipitate given the steel's composition and austenitizing temperature (and an assumed tempering temperature of 900° C.).
[4]Hardened and tempered condition; from T. Fujita, Advanced Materials and Processes, April, 1992.
*Estimated

TABLE III

| | Base composition: 9.5Cr, 0.6Mo, 3.0Co, 1.0Ni + M + C (see below), remainder essentially Fe | | | | | |
|---|---|---|---|---|---|---|
| Example | C (wt. %) | M type | M (wt. %) | $T_{aust}$ (°C.) | Sol. eff. (%) | MX (appm) |
| A | 0.07 | Ti | 0.28 | 1300 | 90 | 2940 |
| P | 0.07 | Ti | 0.28 | 1100 | 26 | 855 |
| L | 0.15 | Ti | 0.75 | 1300 | 34 | 2380 |
| G | 0.05 | Ti | 0.12 | 1300 | 58 | 1360 |
| O | 0.05 | Ti | 0.12 | 1100 | 27 | 628 |
| K | 0.20 | Ti | 0.80 | 1300 | 32 | 2950 |
| E | 0.02 | Ti | 0.08 | 1300 | 78 | 734 |
| R | 0.20 | V | 0.80 | 1100 | 20 | 1854 |
| J | 0.20 | V | 2.00 | 1100 | 35 | 3280 |
| Q | 0.15 | V | 0.70 | 1100 | 16 | 1130 |
| C | 0.06 | Nb | 0.44 | 1300 | 87 | 2271 |
| I | 0.10 | Nb | 0.80 | 1300 | 56 | 2622 |
| F | 0.03 | Nb | 0.20 | 1300 | 66 | 921 |
| D | 0.04 | Ta | 0.60 | 1300 | 81 | 1514 |
| N | 0.04 | Ta | 0.60 | 1200 | 34 | 633 |
| B | 0.06 | Zr | 0.45 | 1300 | 88 | 2467 |
| H | 0.06 | Zr | 0.45 | 1200 | 53 | 1477 |
| M | 0.06 | Hf | 0.80 | 1300 | 36 | 994 |

TABLE IV

| Temperature °C. | Equilibrium solubility products of nitrides and carbides in solid iron | | | | |
|---|---|---|---|---|---|
| | [% V] [% N] | [% Nb] [% N] | [% Ta] [% N] | [% Ti] [% N] | [% Zr] [% N] |
| 1300 | $1.3 \times 10^{-2}$ | $3.1 \times 10^{-3}$ | $8.8 \times 10^{-3}$ | $1.9 \times 10^{-4}$ | $1.6 \times 10^{-6}$ |
| 1200 | $5.3 \times 10^{-3}$ | $1.3 \times 10^{-3}$ | $2.5 \times 10^{-3}$ | $4.2 \times 10^{-7}$ | $<4 \times 10^{-7}$ |
| 1100 | $2.0 \times 10^{-3}$ | $5.0 \times 10^{-4}$ | $5.7 \times 10^{-4}$ | $<1.0 \times 10^{-7}$ | — |
| 1000 | $6.3 \times 10^{-4}$ | $1.6 \times 10^{-4}$ | $1.1 \times 10^{-4}$ | — | — |
| 900 | $1.6 \times 10^{-4}$ | $4.4 \times 10^{-5}$ | $1.5 \times 10^{-5}$ | — | — |
| | [% V] [% C] | [% Nb] [% C] | [% Ta] [% C] | [% Ti] [% C] | [% Zr] [% C] |
| 1300 | — | $2.5 \times 10^{-2}$ | $2.8 \times 10^{-2}$ | $1.8 \times 10^{-2}$ | $2.9 \times 10^{-2}$ |
| 1200 | — | $1.1 \times 10^{-2}$ | $1.4 \times 10^{-2}$ | $6.4 \times 10^{-3}$ | $1.2 \times 10^{-2}$ |
| 1100 | $6.3 \times 10^{-1}$ | $4.6 \times 10^{-3}$ | $6.3 \times 10^{-3}$ | $2.0 \times 10^{-3}$ | $4.7 \times 10^{-3}$ |
| 1000 | $1.8 \times 10^{-1}$ | $1.6 \times 10^{-3}$ | $2.5 \times 10^{-3}$ | $4.9 \times 10^{-4}$ | $1.5 \times 10^{-3}$ |
| 900 | $4.2 \times 10^{-2}$ | $4.8 \times 10^{-4}$ | $8.5 \times 10^{-4}$ | $8.1 \times 10^{-5}$ | $4.2 \times 10^{-4}$ |
| 800 | $7.3 \times 10^{-3}$ | $1.1 \times 10^{-4}$ | $2.4 \times 10^{-4}$ | — | — |

TABLE V

| | Values used in calculating MX and solute efficiency | | | |
|---|---|---|---|---|
| parameter | Example A | Example P | TB12 | HR1200 |
| M | 0.28 | 0.28 | 0.05 | 0.08 |
| $M_A$ | 0.328 | 0.328 | 0.03 | 0.048 |
| N | 0.0 | 0.0 | 0.05 | 0.025 |
| $N_A$ | 0.0 | 0.0 | 0.2 | 0.1 |
| $CN_A$ | 0.327 | 0.327 | 0.574 | 0.614 |
| $C_A/CN_A$ | 1 | 1 | 0.65 | 0.84 |
| $N_A/CN_A$ | 0 | 0 | 0.35 | 0.16 |
| $T_{aust}$ (°C.) | 1300 | 1100 | 1200 | 1200 |
| $M_A$ $CN_A$ | 0.107 | 0.107 | 0.0173 | 0.0295 |
| $M_A + CN_A$ | 0.655 | 0.655 | 0.604 | 0.662 |
| $K_{MX,aust.}$ | 0.1 | 0.011 | $2 \times 10^{-2}$ | $3 \times 10^{-2}$ |
| $M_{CN,p}$ | 0.0135 | 0.221 | 0 | 0 |
| Mp | 0.315 | 0.107 | 0.03 | 0.048 |

TABLE V-continued

| | Values used in calculating MX and solute efficiency | | | |
|---|---|---|---|---|
| parameter | Example A | Example P | TB12 | HR1200 |
| CN,p | 0.314 | 0.106 | 0.574 | 0.614 |
| $K_{MX,900}$ | $4.4 \times 10^{-4}$ | $4.4 \times 10^{-4}$ | $1 \times 10^{-3}$ | $1 \times 10^{-3}$ |
| $V/V_A$ | — | — | .2/.22 | .2/.22 |
| $K_{VX,aust.}$ | — | — | 2.11 | 3.24 |
| $CN_S$ | — | — | 0.574 | 0.614 |
| Vp | — | — | 0.22 | 0.22 |
| $K_{VX,900}$ | — | — | 0.14 | 0.18 |
| Vp $CN_S$ | — | — | 0.126 | 0.135 |
| $VP + CN_S$ | — | — | 0.794 | 0.834 |
| Mp $CN_P$ | 0.099 | 0.0113 | 0.0172 | 0.0295 |
| $Mp + CN_P$ | 0.629 | 0.213 | 0.604 | 0.662 |
| MX (appm) | 2940 | 855 | 283 | 462 |
| sol. eff. (%) | 90 | 26 | 5 | 8 |

TABLE VI

| parameter | Values used in calculating MX and solute efficiency | | | | |
|---|---|---|---|---|---|
| | Mod9Cr-1Mo | ModNSCR9 | TR1100 | TR1150 | TR1200 |
| M | 0.08 | 0.05 | 0.055 | 0.06 | 0.08 |
| $M_A$ | 0.048 | 0.03 | 0.033 | 0.036 | 0.048 |
| N | 0.05 | 0.03 | 0.04 | 0.045 | 0.05 |
| $N_A$ | 0.2 | 0.12 | 0.16 | 0.18 | 0.2 |
| $CN_A$ | 0.667 | 0.494 | 0.814 | 0.787 | 0.807 |
| $C_A/CN_A$ | 0.7 | 0.76 | 0.8 | 0.77 | 0.75 |
| $N_A/CN_A$ | 0.3 | 0.24 | 0.2 | 0.23 | 0.25 |
| $T_{aust}$ (°C.) | 1050 | 1100 | 1100 | 1150 | 1200 |
| $M_A\ CN_A$ | 0.032 | 0.0148 | 0.0269 | 0.0283 | 0.0387 |
| $M_A + CN_A$ | 0.715 | 0.524 | 0.847 | 0.823 | 0.855 |
| $K_{MX,aust.}$ | $6 \times 10^{-3}$ | $1.1 \times 10^{-2}$ | $1.1 \times 10^{-2}$ | $2 \times 10^{-2}$ | $2.3 \times 10^{-2}$ |
| $M_{CN,p}$ | 0.0384 | 0.0074 | 0.0192 | 0.0102 | 0.0188 |
| Mp | 0.0096 | 0.0226 | 0.0138 | 0.0258 | 0.0292 |
| CN,p | 0.629 | 0.486 | 0.795 | 0.777 | 0.788 |
| $K_{MX,900}$ | $1 \times 10^{-3}$ | $1 \times 10^{-3}$ | $1 \times 10^{-3}$ | $1 \times 10^{-3}$ | $1 \times 10^{-3}$ |
| $V/V_A$ | .21/.231 | .16/.176 | .17/.187 | .17/.187 | .2/.22 |
| $K_{VX,aust.}$ | 2.27 | 2.46 | 2.59 | 2.5 | 2.43 |
| $CN_S$ | 0.629 | 0.486 | 0.795 | 0.777 | 0.788 |
| Vp | 0.231 | 0.176 | 0.187 | 0.187 | 0.22 |
| $K_{VX,900}$ | 0.15 | 0.164 | 0.173 | 0.167 | 0.162 |
| Vp $CN_S$ | 0.146 | 0.085 | 0.149 | 0.145 | 0.17 |
| VP + $CN_S$ | 0.86 | 0.662 | 0.981 | 0.964 | 1.01 |
| Mp $CN_P$ | $6 \times 10^{-3}$ | $1.1 \times 10^{-2}$ | $1.1 \times 10^{-2}$ | $2 \times 10^{-2}$ | 0.023 |
| Mp + $CN_P$ | 0.638 | 0.509 | 0.808 | 0.803 | 0.817 |
| MX (appm) | 79 | 206 | 124 | 244 | 313 |
| sol. eff. (%) | 1 | 4 | 2 | 3 | 4 |

I claim:

1. An iron based alloy having good corrosion resistance and high strength at elevated temperatures consisting essentially of 0.05–0.15% carbon, 2–15% chromium, 0.1–10.0% cobalt, 0.1–4.0% nickel, 0.1–2.0% molybdenum, 0.1–0.75% titanium, less than 0.1% boron, less than 0.02% nitrogen, and the remainder essentially iron plus impurities in which alloy is heat treated to be a face centered cubic structure at temperatures above about 900° C. and body centered cubic structure on cooling.

2. The alloy as claimed in claim 1 wherein the alloy is in an as cast condition.

3. The alloy as claimed in claim 1 wherein the alloy is in a forged condition.

4. The alloy of claim 1 also comprising less than 5% copper, less than 5% manganese, less than 1.5% silicon, less than 2% zirconium, less than 4% tantalum, less than 4% hafnium, less than 1% niobium, less than 2% vanadium, less than 0.1% of each member of the group consisting of aluminum, cerium, magnesium, scandium, yittrium,lanthanum, beryllium, and boron, less than 0.02% of each member and less than 0.1 total weight percent of all members of the group consisting of sulfur, phosphorus, tin, antimony, and oxygen.

5. The alloy of claim 4 wherein Cr+Ni is in the range 5.0% to 14.5%.

6. The alloy of claim 4 wherein W+Si+Mo is less than 4%.

7. The alloy of claim 4 wherein:

$0.135 < 1.17Ti + 0.6Zr + 0.31Ta + 0.31Hf < 1.0$.

8. The alloy of claim 4 wherein the structure contains less than 40% delta ferrite by volume.

9. The alloy of claim 4 having an Ac1 temperature between 500° C. and 820° C.

10. The alloy of claim 1 also comprising less than 5% copper, less than 5% manganese, less than 1.5% silicon, less than 2% zirconium, less than 4% tantalum, less than 4% hafnium, less than 1% niobium, less than 2% vanadium, less than 0.1% of each member of the group consisting of aluminum, cerium, magnesium, scandium, yittrium, lanthanum, beryllium, and boron, less than 0.02% of each member and less than 0.1 total weight percent of all members of the group consisting of sulfur, phosphorus, tin, antimony, and oxygen,and wherein Cr+Ni is in the range 5.0% to 14.5%, W+Si+Mo is less than 4%, $0.135 < 1.17Ti + 0.6Zr + 0.31Ta + 0.31Hf < 1.0$, and the structure contains less than 40% delta ferrite by volume.

11. The alloy of claim 10 having an Ac1 temperature between 500° C. and 820° C.

12. An iron base alloy having good corrosion/oxidation resistance and high strength at elevated temperatures consisting essentially of 0.05–0.15% C, 7.5–14.5% Cr less than 5% Ni, 5.0%–14.5% Cr+Ni, less than 10% Co, more than 1% Co+Ni, less than 5% Cu, less than 5% Mn, less than 2.6% Mo, less than 1.5% Si, W+Si+Mo<4%, less than 0.75% Ti, less than 2% Zr, less than 4% Ta, less than 4% Hf; Ti, Zr, Ta, Hf present such that $0.135 < 1.17Ti + 0.6Zr + 0.31Ta + 0.31Hf < 1.0$, less than 1% Nb, less than 2% V, less than 0.02% N and N−0.5Al<0.015, less than 0.1% Al, B, Ce, Mg, Sc, Y, La, and Be, less than 0.1% total and less than 0.02% of each of S, P, Sn, Sb, O, and the balance essentially iron in which the structure contains less than 40% delta ferrite, and the Ac1 temperature is between 500° C. and 820° C.

13. The alloy claimed in claim 12 wherein the alloy is in a cast condition.

14. The alloy claimed in claim 12 wherein the alloy is in a forged condition.

15. A method for producing an iron base alloy having good corrosion/oxidation resistance and high strength at elevated temperatures comprising the steps of:

a) preparing a transformable austenitic iron base alloy which alloy is a face centered cubic structure at temperatures above about 900° C. and body centered cubic structure on cooling the alloy consisting essentially of less than 15% Cr, less than 0.2%

C, less than 0.1% N, less than 2% Si, less than 4% Mo, less than 4% W, less than 5% Ni, less than 5% Mn, less than 5% Cu, less than 10% Co, less than 4% V, and $0.1<1.17Ti+0.6Nb+0.6Zr+0.31Ta+0.31Hf<1.0$;

b) solution heat treating the alloy at a temperature higher than 1100° C., so that the alloy has a structure at said solutionizing temperature which is greater than 60% austenite; and c) cooling the alloy in such a way as to result in one of a martensitic, bainitic and ferritic microstructure with an Ac1 temperature greater than 500° C., that contains a fine dispersion of MX precipitates (where M=Zr, V, Ti, Ta, Hf, Nb; and X=C, N), in which the alloy has an MX number density of at least 500 atomic number pairs per million.

16. The method of claim 15 also comprising the step of heat treating the alloy after cooling.

17. The method of claim 15 wherein the cooling step comprises the steps of:

a) cooling the alloy to a selected temperature above ambient temperature;

b) maintaining the alloy at the selected temperature for a selected time; and c) cooling the alloy to room temperature.

18. The method of claim 17 wherein the selected temperature is 900° C. and the selected time is about ½ hour.

19. An iron based alloy having good corrosion/oxidation resistance and high strength at elevated temperatures comprising less than 15% Cr, less than 0.2% C, less than 0.1% N, less than 2% Si, less than 4% Mo, less than 4% Si, less than 5% Ni, less than 5% Mn, less than 5% Cu, less than 10% Co, less than 4% V, at least one of Ti, Nb, Zr, Ta, and Hf in an amount so that $$0.1<1.17Ti+0.6Nb+0.6Zr+0.31Ta+0.31Hf<1.0;$$

and the balance iron, the alloy containing a fine dispersion of MX precipitates (where M=Zr, V, Ti, Ta, Hf, Nb; and X=C, N), in which the alloy has an MX number density of at least 500 atomic number pairs per million.

20. The alloy of claim 19 wherein the alloy has a solute efficiency of at least 10%.

21. The method of claim 17 also comprising the step of hot working the alloy at the selected temperature.

* * * * *

UNITED STATES PATENT AND TRADEMARK OFFICE

CERTIFICATE OF CORRECTION

PATENT NO. : 5,310,431

DATED : May 10, 1994

INVENTOR(S) : BUCK, Robert F. and GARRISON, Warren M., Jr.

It is certified that error appears in the above-identified patent and that said Letters Patent is hereby corrected as shown below:

Cover page, change address of inventor from "N. Huntingdon, PA" to "Trafford, PA".
Coverpage, add "Warren M. Garrison, Jr., Pittsburgh, PA" as co-inventor.
Coverpage, change address of assignee from "North Huntingdon, PA" to "Trafford, PA".
In Column 1, line 55, the words "content have" should be "contents has".
In Column 1, line 65, the numbers "9-2" should be "9-12".
In Column 5, line 12, the words "int he" should be "in the".
In Column 5, line 19, the letters "hf" should be "Hf".
In Column 9, line 67, delete the comma between "literature" and "for".
In Column 10, line 35, to the right of the equation insert "(1)".
In Column 10, line 42, the words "(b1)" should be "(2)".
In Column 10, line 49, insert to the right of the equation "(3)".
In Column 10, line 52, insert to the right of the equation "(4)".
In Column 10, line 60, insert to the right of the equation "(5)".
In Column 17, line 39, the words "as cast" should be "as-cast".
In Column 17, line 48, the owrds "yittrium,lanthanum" should be "yttrium, lanthanum".
In Column 18, line 29, the words "oxygen,and" should be "oxygen, and".
In Column 20, line 11, the letters "Si" should be "W".

Signed and Sealed this

First Day of June, 1999

*Attest:*

Q. TODD DICKINSON

*Attesting Officer*

*Acting Commissioner of Patents and Trademarks*